US006989808B2

(12) United States Patent
Hanaoka et al.

(10) Patent No.: US 6,989,808 B2
(45) Date of Patent: Jan. 24, 2006

(54) DRIVING OF A LIQUID CRYSTAL DISPLAY DEVICE

(75) Inventors: Kazutaka Hanaoka, Kawasaki (JP); Yuichi Inoue, Kawasaki (JP); Seiji Tanuma, Kawasaki (JP); Makoto Ohashi, Kawasaki (JP)

(73) Assignee: Fujitsu Display Technologies Corporation, Kawasaki (JP)

( * ) Notice: Subject to any disclaimer, the term of this patent is extended or adjusted under 35 U.S.C. 154(b) by 0 days.

(21) Appl. No.: 09/473,868

(22) Filed: Dec. 28, 1999

(65) Prior Publication Data

US 2003/0071774 A1 Apr. 17, 2003

(30) Foreign Application Priority Data

Dec. 28, 1998 (JP) ..... 10-374813

(51) Int. Cl.
*G09G 3/36* (2006.01)

(52) U.S. Cl. ..... 345/89; 345/85; 345/89; 345/92; 345/93; 345/98; 345/99; 345/103; 349/100; 349/101; 349/141; 349/143; 349/151

(58) Field of Classification Search ..... 345/90, 345/92, 93, 99, 89, 85, 103, 98, 100; 349/141, 349/143, 151, 100, 101; 257/59
See application file for complete search history.

(56) References Cited

U.S. PATENT DOCUMENTS

| | | | | | |
|---|---|---|---|---|---|
| 5,185,601 | A | * | 2/1993 | Takeda et al. | 349/39 |
| 5,426,447 | A | * | 6/1995 | Lee | 345/103 |
| 5,483,263 | A | * | 1/1996 | Bird et al. | 345/207 |
| 5,610,736 | A | * | 3/1997 | Asai | 349/42 |
| 5,614,730 | A | * | 3/1997 | Nakazawa et al. | 257/59 |
| 5,828,356 | A | * | 10/1998 | Stoller | 345/60 |
| 5,936,598 | A | * | 8/1999 | Hayama et al. | 345/76 |
| 5,943,106 | A | * | 8/1999 | Sukenori et al. | 349/39 |
| 6,005,646 | A | * | 12/1999 | Nakamura et al. | 349/33 |
| 6,064,460 | A | * | 5/2000 | Ohta et al. | 349/141 |
| 6,476,901 | B2 | * | 11/2002 | Fujioka et al. | 349/149 |
| 6,504,594 | B2 | * | 1/2003 | Ohe et al. | 349/141 |
| 6,507,045 | B2 | * | 1/2003 | Gu et al. | 257/72 |

* cited by examiner

*Primary Examiner*—Xiao Wu
*Assistant Examiner*—Abbas Abdulselam
(74) *Attorney, Agent, or Firm*—Greer, Burns & Crain, Ltd.

(57) ABSTRACT

A liquid crystal display device includes a d.c. voltage source for producing a common voltage such that the common voltage is substantially equal to a central voltage of a bipolar voltage signal.

17 Claims, 8 Drawing Sheets

DRIVING OF A LIQUID CRYSTAL DISPLAY DEVICE

BACKGROUND OF THE INVENTION

The present invention generally relates to liquid crystal display devices and more particularly to the driving of an active-matrix liquid crystal display device in which representation of images is achieved by applying a driving voltage to a liquid crystal layer via a thin-film transistor (TFT).

Liquid crystal display devices have various advantageous features such as compact size, light weight, low power consumption, and the like. Thus, liquid crystal display devices are used extensively in portable information processing apparatuses such as lap-top computers or palm-top computers. Further, liquid crystal display devises are used also in desktop computers in these days.

A typical liquid crystal display device includes a liquid crystal layer confined between a pair of glass substrates and achieves representation of images by inducing a change in the orientation of liquid crystal molecules in the liquid crystal layer by applying a driving voltage to the liquid crystal layer. Such a change in the orientation of the liquid crystal molecules causes a change in the optical property of the liquid crystal layer.

In the case of using such a liquid crystal display device in a high-resolution color representation apparatus, there is a need of driving the individual pixels or liquid crystal cells defined in the liquid crystal layer at a high speed. In order to meet this requirement, it is generally practiced to provide a thin-film transistor in correspondence to each of the pixels in the liquid crystal layer and to drive the liquid crystal cells by way of such thin-film transistors.

FIG. 1 shows the construction of a liquid crystal panel 10 used in such an active matrix liquid crystal display device of a related art in a plan view, while FIG. 2 shows the part circled in FIG. 1 in a cross-sectional view.

Referring to FIG. 2, the liquid crystal panel 10 generally includes a pair of glass substrates 10A and 10B, and a liquid crystal layer 10C is confined between the substrates 10A and 10B.

As represented in the plan view of FIG. 1, the glass substrate 10A carries thereon a number of thin-film transistors $\mathbf{11}_1$–$\mathbf{11}_4$ corresponding to the pixels in a row and column formation, wherein the thin-film transistors $\mathbf{11}_1$ and $\mathbf{11}_2$ aligned in the row direction are connected commonly to a gate bus line $G_1$ provided directly on the glass substrate 10A. Similarly, the thin-film transistors $\mathbf{11}_3$ and $\mathbf{11}_4$ are connected commonly to a gate bus line $G_2$ provided directly on the glass substrate 10A. Further, the glass substrate 10A carries thereon a number of generally H-shaped auxiliary electrodes Cs at the level of the gate bus lines $G_1$ and $G_2$, wherein the auxiliary electrode Cs is covered by an insulation film 12 as represented in the cross-sectional view of FIG. 2, and data bus lines $D_1$ and $D_2$ are formed on the insulation film 12 so as to extend in the column direction as represented in the plan view of FIG. 1.

It should be noted that the data bus lines $D_1$ and $D_2$ are covered by another insulation film 13 as represented in the cross-sectional view of FIG. 2, and the data bus line $D_1$ is connected to the respective source regions of the thin-film transistors $\mathbf{11}_1$ and $\mathbf{11}_2$ via a conductor pattern branched from the data bus line $D_1$. Similarly, the data bus line $D_2$ is connected to the respective source regions of the thin-film transistors $\mathbf{11}_2$ and $\mathbf{11}_4$ via a conductor pattern branched from the data bus line $D_2$.

Further, there is provided a rectangular pixel electrode of a transparent conductor such as ITO on the insulation film 13 in correspondence to the drain region of each of the thin-film transistors. For example, the drain region of the thin-film transistor $\mathbf{11}_1$ is connected to a transparent pixel electrode $P_1$ provided on the insulation film 13 via a contact hole formed in the insulation film 13. As can be seen from FIGS. 1 and 2, the auxiliary electrode Cs is disposed at both sides of the data bus line $D_1$ or $D_2$ when viewed in the direction perpendicular to the substrate 10A, such that the electrode Cs overlaps the edge part of the transparent pixel electrode $P_1$ or $P_2$. Thereby, the auxiliary electrode Cs forms an auxiliary capacitor together with the transparent pixel electrode $P_1$ or $P_2$.

Further, each of the transparent pixel electrodes $P_1$ and $P_2$ is covered by a molecular alignment film 14, wherein the molecular alignment film 14, contacting directly with the liquid crystal layer 10C, induces an alignment of the liquid crystal molecules in the liquid crystal layer 10C in a predetermined direction.

The opposing substrate 10B, on the other hand, carries a color filter CF in correspondence to the foregoing transparent pixel electrode $P_1$ or $P_2$, and a transparent opposing electrode 15 of ITO, and the like, is provided uniformly on the substrate 10B. It should be noted that the transparent opposing electrode 15 is covered by another molecular alignment film 16, and the molecular alignment film 16 induces an alignment of the liquid crystal molecules in the liquid crystal layer 10C in a desired direction. Further, the substrate 10B carries thereon an opaque mask BM in correspondence to a gap between a color filter CF and an adjacent color filter CF.

FIG. 3 shows an example of the driving signal supplied to the data bus line $D_1$ or $D_2$ when driving the liquid crystal panel 10 of FIGS. 1 and 2.

Referring to FIG. 3, a bipolar driving pulse signal is supplied to the data bus line from a driving circuit, wherein it should be noted that the bipolar driving pulse signal changes a polarity thereof between a positive peak level of $+V_D$ and a negative peak level $-V_D$ during the black mode of the liquid crystal panel 10 for representing a black image. Further, a predetermined common voltage $V_{Cs}$ is supplied to the opposing electrode 15 and the auxiliary electrode Cs from another D.C. voltage source during the black mode. In the white mode of the liquid crystal panel 10 for representing a white image, on the other hand, on the other hand, a bipolar drive pulse signal having an amplitude smaller than a predetermined threshold voltage is supplied to the foregoing data bus line $D_1$ or $D_2$.

It should be noted that the foregoing D.C. voltage source for supplying the common voltage $V_{Cs}$ is provided as an independent unit independent from the driving circuit used for driving the data bus line $D_1$ or $D_2$. The D.C. voltage source provides a voltage of $\Delta Vc$ as the foregoing common voltage $V_{Cs}$, wherein the common voltage $V_{Cs}$ thus set is slightly offset from the central voltage Vc of the bipolar driving pulse signal. It should be noted that the liquid crystal panel 10 of FIG. 1 or 2 uses a low voltage liquid crystal, characterized by the black mode drive voltage $V_D$ of about 5 V or less, for the liquid crystal layer 10C.

In the liquid crystal panel 10 driven as such, it should be noted that the optimum common voltage $V_{Cs}$ changes slightly between the black representation mode and the white representation mode. More specifically, the optimum common voltage $V_{Cs}$ coincides substantially with the central voltage Vc of the bipolar driving pulse signal ($\Delta Vc=0$) in the black representation mode, while the optimum common voltage deviates from the central voltage Vc ($\Delta Vc \neq 0$) in the half-tone or white representation mode. As the common voltage $V_{Cs}$ is applied uniformly to the opposing electrode 15, it is difficult to change the common voltage adaptively depending on the content of the image to be represented. Thus, it has been practiced to fix the common voltage $V_{Cs}$ to the optimum voltage at the time of the half-tone representation mode.

Meanwhile, the inventor of the present invention has noticed, in a liquid crystal panel using a low voltage liquid crystal for the liquid crystal layer 10C, that there appears a noticeable flicker in the represented images along the edge part of the auxiliary electrode Cs. In the investigation that constitutes the foundation of the present invention, the inventor has studied this phenomenon and discovered that the flicker is caused as a result of variation of the disclination which is induced in the liquid crystal layer 10C in the region including the data bus line $D_1$ or $D_2$ and the auxiliary electrode Cs by a strong lateral electric field.

FIGS. 4A and 4B show the alignment of the liquid crystal molecules in the liquid crystal layer 10C and the electric flux of the lateral electric field applied to the liquid crystal layer for the case in which the common voltage $V_{Cs}$ applied to the auxiliary electrode Cs and the opposing electrode 15 is offset from the central voltage of the bipolar driving pulse signal ($V_{Cs} \neq Vc$, wherein FIG. 4A shows the state in which a voltage of +5V is applied to the data bus line $D_1$ or $D_2$ (represented as "D"), while FIG. 4B shows the state in which a voltage of −5V is applied to the data bus line D.

Referring to FIG. 4A, it can be seen that a very large lateral electric field is created between the data bus line D and the adjacent auxiliary electrode Cs in the state the voltage of +5V is applied to the data bus line D. Associated with this, there occurs a conspicuous disturbance in the molecular orientation or disclination in the liquid crystal layer 10C in correspondence to the part between the data bus line D and the auxiliary electrode Cs. As a result of the formation of such a disclination, there is induced a domain structure in the liquid crystal layer 10C, and a leakage of light occurs in correspondence to the boundary of the domains as represented in FIG. 4A by arrows.

In the state of FIG. 4B in which a voltage of −5V is applied to the data bus line D, on the other hand, the lateral electric field applied to the liquid crystal layer 10C is substantially reduced and there occurs no substantial formation of domain structure or associated problem of leakage of the light. As the state of FIG. 4A and FIG. 4B appears alternately in correspondence to the polarity of the bipolar driving signal pulse, the leakage light appearing only in the state of FIG. 4A causes the flicker.

Further, the inventor of the present invention has discovered that there occurs a flow of the liquid molecules in the liquid crystal layer 10C in the rubbing direction of the molecular alignment film when the value of the common voltage $V_{Cs}$ of the auxiliary electrode Cs is deviated from the central voltage of the bipolar driving pulse signal. When such a flow occurs in the liquid crystal layer 10C, there occurs an increase in the thickness of the liquid crystal layer 10C in correspondence to the part where the liquid crystal molecules are accumulated. When there occurs such a change in the thickness of the liquid crystal layer 10C, the optical property of the liquid crystal panel 10 is modulated also.

Further, in the case a low-voltage liquid crystal is used for the liquid crystal layer 10C, there tends to occur a sticking of images as a result of the accumulation of impurity ions associated with the flow of the liquid crystal molecules. It should be noted that such a low-voltage liquid crystal, characterized by a low driving voltage, is particularly vulnerable to contamination.

SUMMARY OF THE INVENTION

Accordingly, it is a general object of the present invention to provide a novel and useful driving method of a liquid crystal display device wherein the foregoing problems are eliminated.

Another and more specific object of the present invention is to provide a method of driving a liquid crystal display device, said liquid crystal display device comprising: a first substrate; a second substrate opposing said first substrate with a gap therebetween; a liquid crystal layer confined in said gap; a thin-film transistor formed on said first substrate; a conductor pattern formed on said first substrate in electrical connection with said thin-film transistor, said conductor pattern supplying an alternate-current driving voltage signal to said thin-film transistor; a pixel electrode provided on said first substrate in electrical connection to said thin-film transistor; an auxiliary electrode formed on said first substrate in the vicinity of said conductor pattern so as to form an auxiliary capacitance with said pixel electrode, said auxiliary electrode being disposed so as to induce a lateral electric field between said auxiliary electrode and said conductor pattern; and an opposing electrode formed on said second substrate;

said method comprising the step of:

applying to said auxiliary electrode a common voltage substantially equal to a central voltage of said alternate-current driving voltage signal.

Other objects and further features of the present invention will become apparent from the following detailed description when read in conjunction with the attached drawings.

DETAILED DESCRIPTION OF THE PREFERRED EMBODIMENTS

[First Embodiment]

Figure 5:
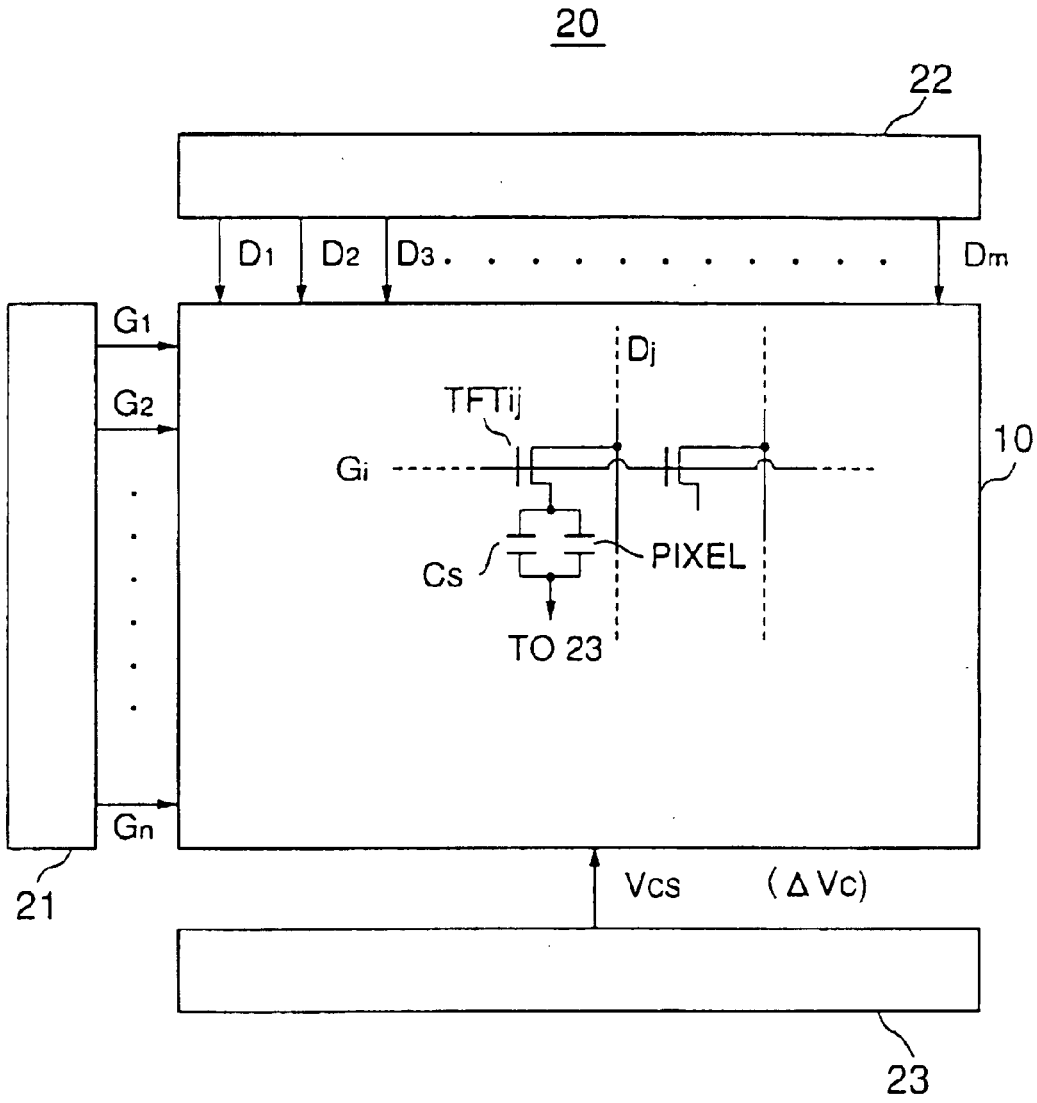
FIG. 5 is a diagram showing the construction of a liquid crystal display device according to a first embodiment of the present invention in a block diagram.

FIG. 5 shows the construction of a liquid crystal display device 20 according to a first embodiment of the present invention, wherein those parts corresponding to the parts described previously are designated by the same reference numerals and the description thereof will be omitted.

Referring to FIG. 5, the liquid crystal display device 20 includes, in addition to the liquid crystal panel 10 described previously with reference to FIGS. 1 and 2, a scanning-electrode driving circuit 21 for selectively activating the gate bus lines $G_1$–$G_n$ and a signal electrode driving circuit 22 for supplying the A.C. driving signal explained with reference to FIG. 3 to the data bus lines $D_1$–$D_m$, and there is further provided a D.C. voltage source 23 supplying the common voltage $V_{Cs}$ to the opposing electrode 15 and to the auxiliary electrode Cs as a common voltage supply source. FIG. 5 further indicates a capacitor PIXEL, wherein it should be noted that the capacitor PIXEL represents the capacitance formed between the transparent pixel electrode $P_1$ or $P_2$ and the transparent opposing electrode 15.

Figure 3:
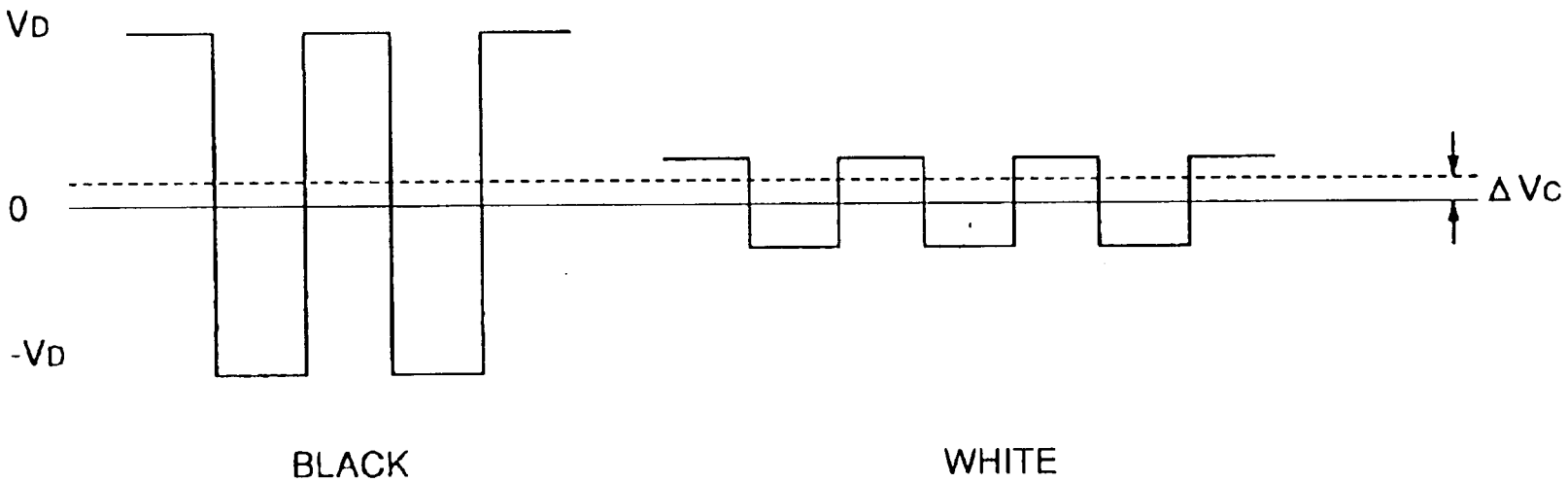
FIG. 3 is a diagram showing the waveform of a driving signal used in the liquid crystal display device of FIGS. 1 and 2.
Figure 4A:
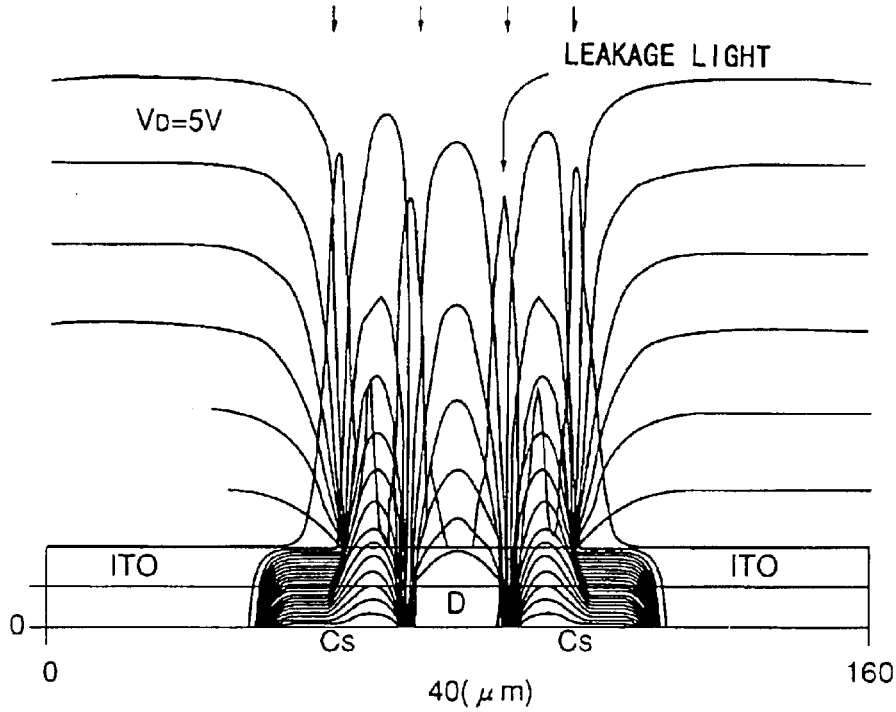
FIGS. 4A and 4B are diagrams showing the electric flux line and the alignment of the liquid crystal molecules in a liquid crystal layer used in the liquid crystal display panel of FIGS. 1 and 2.
Figure 4B:
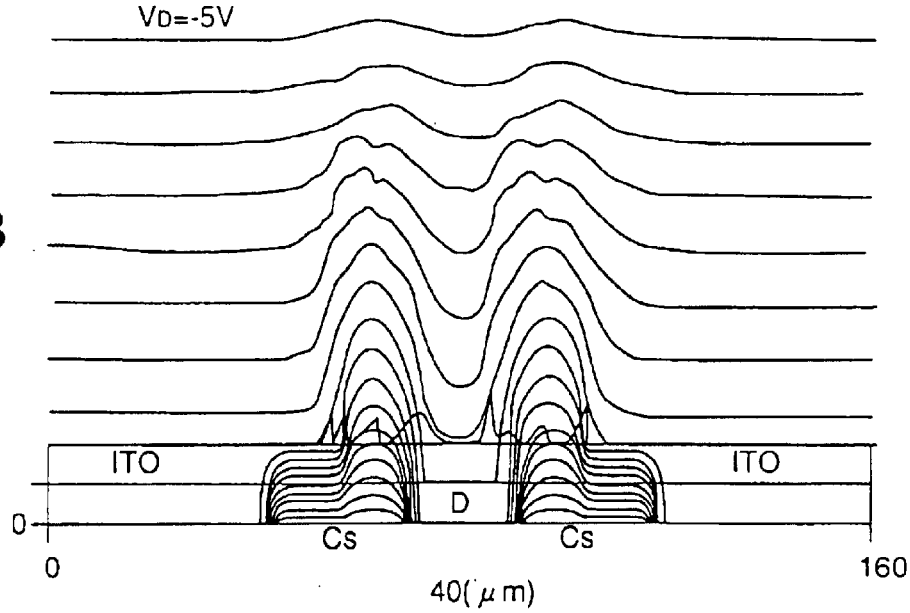

The liquid crystal display device 20 of FIG. 5 is a so-called low-voltage liquid crystal display device and the signal electrode driving circuit supplies a bipolar driving voltage pulse signal similar to the one shown in FIG. 3 to the data bus lines $D_1$–$D_m$ with an amplitude of ±5V.

In the present invention, the inventor has discovered that the formation of the disclination becomes substantially the same in the state in which a driving voltage pulse of +5V is applied to the selected data bus line $D_1$–$D_m$ and in the state in which a driving voltage pulse of −5V is applied to the selected data bus line $D_1$–$D_m$, by setting the common voltage $V_{Cs}$ supplied from the common voltage source 23, to be equal to the central voltage (0V) of the bipolar driving voltage pulse signal. As a result, although the leakage of the light itself is not eliminated, the flicker of the leakage light is successfully eliminated. Further, it was discovered that, by setting the voltage $V_{Cs}$ as set forth above, the sticking of images caused as a result of the flow of the liquid crystal molecules in the liquid crystal layer 11C, is also suppressed successfully.

Figure 6A:
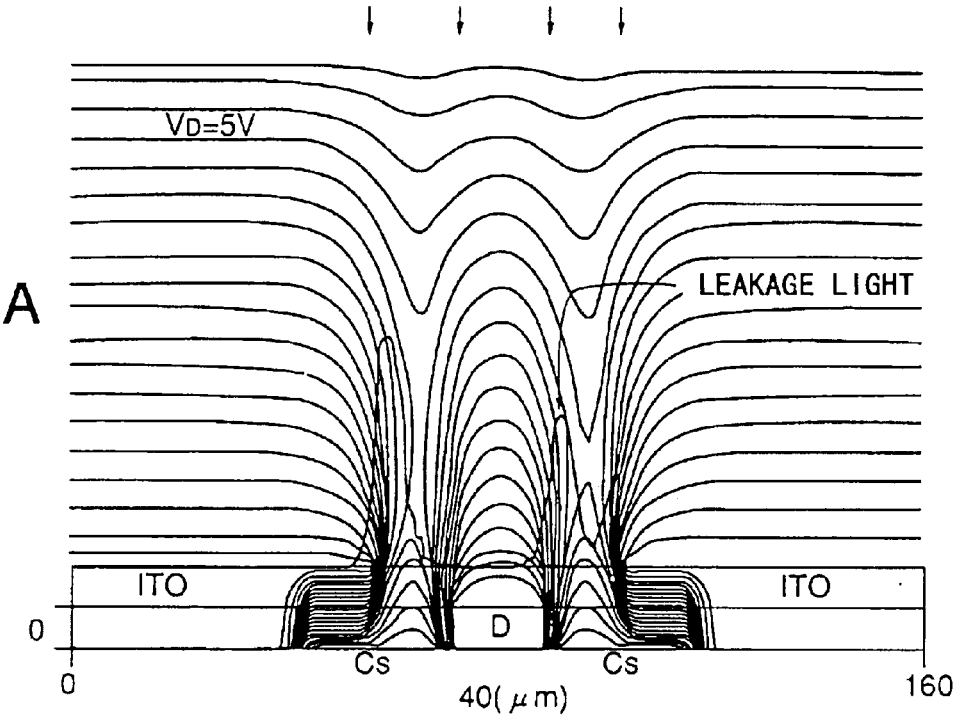
FIGS. 6A and 6B are diagrams showing the electric flux line and the alignment of the liquid crystal molecules in a liquid crystal layer used in the liquid crystal display panel of FIG. 5.
Figure 6B:
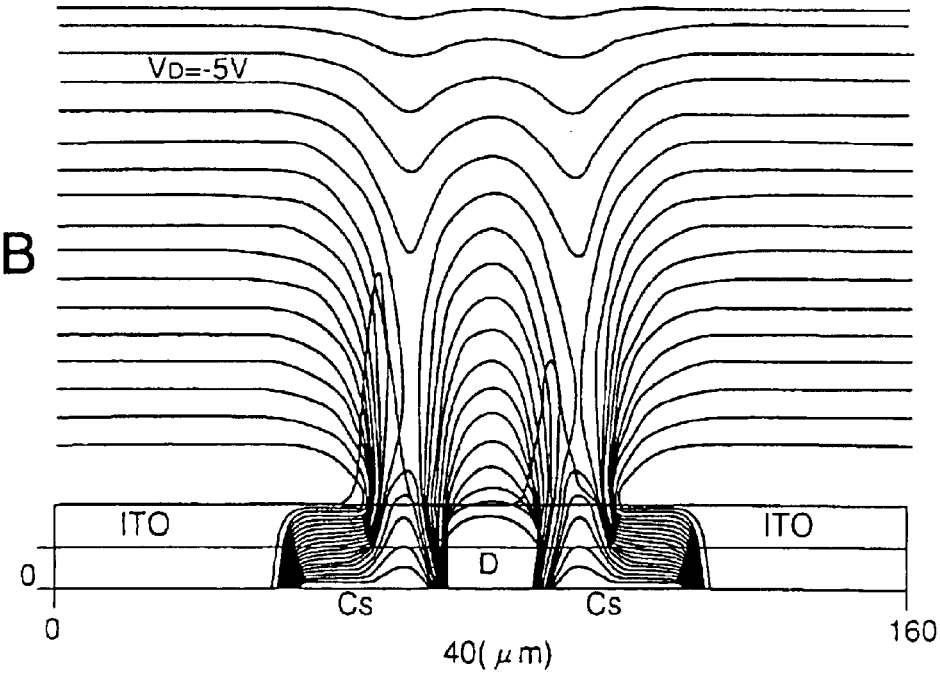

FIGS. 6A and 6B show the electric flux in the liquid crystal layer 10C for the case in which the common voltage $V_{Cs}$ is set to 0 V.

Referring to FIGS. 6A and 6B, it can be seen that, although the disclination formation in the liquid crystal layer 10C by the lateral electric field is not avoidable, the degree of the disclination in the liquid crystal layer 10C is more or the same in the state of FIG. 6A in which a driving voltage pulse of +5V is applied to the selected signal electrode $D_1$–$D_m$ and in the state of FIG. 6B in which a driving voltage pulse of −5V is applied to the selected signal electrode $D_1$–$D_m$. As a result, there occurs no substantial flicker in the light that has leaked through the liquid crystal display device.

Further, as a result of the reduced disclination formation in the liquid crystal layer 10C caused by the foregoing setting of the common voltage $V_{Cs}$, the flow of the liquid crystal molecules is also reduced. As a result, the problem of thickness increase in the liquid crystal layer 10C and associated problem of local accumulation of the impurity ions in the liquid crystal layer 10C are effectively reduced. Thus, the present invention reduces the sticking of images in the liquid crystal display device 20 of FIG. 5 by setting the common voltage $V_{Cs}$ to be equal to 0V.

Figure 7:
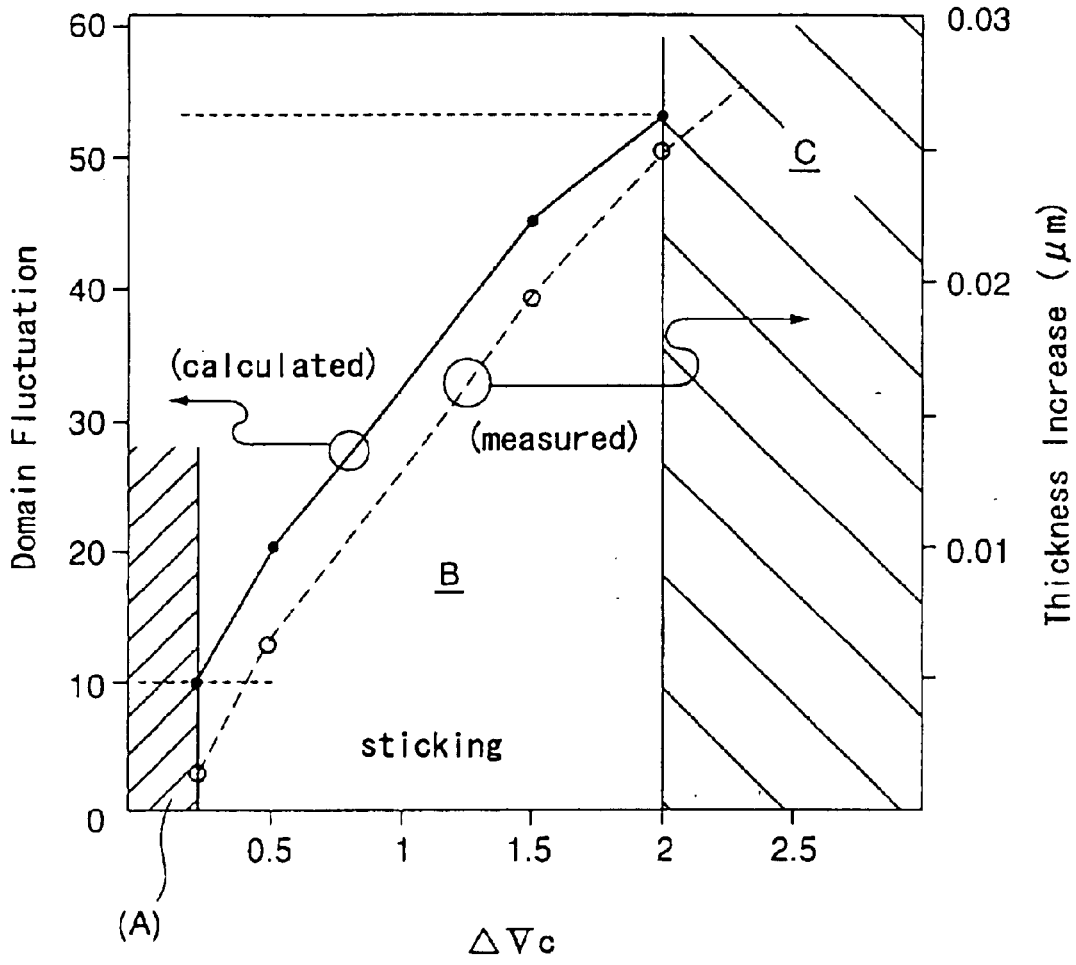
FIG. 7 is a diagram showing the possible range of an optimum common voltage according to the first embodiment of the present invention.

FIG. 7 shows the flicker formation in the liquid crystal panel 10 having a 12-inch diagonal size for the case in which the common voltage $V_{Cs}$ is changed variously, wherein FIG. 7 represents the flicker formation represented in terms of a domain fluctuation DF defined as $$DF=(B_p-B_n)/B_p\times 100(B_p>B_n),$$

where $B_p$ represents the leakage of light during the positive frame interval in which a positive drive voltage pulse of +5V is applied, while $B_n$ represents the leakage of light during the negative frame interval in which a negative drive voltage pulse of −5V is applied. Further, FIG. 7 represents the thickness increase observed for the liquid crystal layer 10C of the liquid crystal display device 20 of FIG. 5, wherein the thickness increase was measured at a point offset from the right upper corner of the 12-inch panel 10 by a distance of 2 cm in the lateral direction and 2 cm in the longitudinal direction. The measurement was made after 20 minutes of operation.

Referring to FIG. 7, it can be seen that the domain fluctuation, and hence the flicker formation, increases with increasing deviation of the common voltage $V_{Cs}$ from the central voltage of the bipolar driving voltage pulse. Further, it can be seen that there appears a liquid crystal flow in the panel diagonal direction along the rubbing direction of the molecular alignment film 14, wherein the liquid crystal flow appears particularly conspicuously in the black representation mode in which the amplitude of the driving voltage pulse signal applied to the liquid crystal panel 10 becomes maximum. As a result, the cell thickness of the liquid crystal layer 10C is also increased. As explained already, such an increase in the liquid crystal cell thickness tends to invite an accumulation of impurity ions contained in the liquid crystal, and the contamination of the liquid crystal by such an accumulation of the impurity ions induces a conspicuous sticking in the represented images.

In FIG. 7, it can be seen that, in a region A in which the deviation $\Delta_C$ of the common voltage $V_{Cs}$ is less than about 0.025V, in other words in the region A in which the foregoing deviation $\Delta V_C$ is less the about 1/20 of the voltage amplitude (5V) of the drive voltage pulse, the domain fluctuation DF is less than about 10% and no substantial sticking of images is recognized. On the contrary, in a region B in which the foregoing deviation $\Delta V_C$ exceeds 0.25V but is smaller than about 2V, a linear sticking was recognized. Further, in a region C in which the deviation $\Delta V_C$ exceeds about 2V, the domain fluctuation exceeds 50% and a considerable flicker is recognized. Further, the thickness increase of the liquid crystal layer 10C reaches as much as 0.025 μm. In this case, the liquid crystal molecules are caused to flow in the liquid crystal layer 10C with a velocity such that the liquid crystal molecules move by a distance of more than 80 μm during the interval of 24 hours.

From the foregoing, it is preferable to set the common voltage $V_{Cs}$ in the region B in which the deviation $\Delta V_C$ with respect to the amplitude center of the bipolar driving pulse voltage signal is less than about 50% of the maximum voltage amplitude for the black representation mode, more preferably in the region A in which the deviation $\Delta V_C$ is less than about 10%. In the region B, it should be noted that the liquid crystal molecules in the liquid crystal layer 10C moves over a distance of 80 μm or less during the interval of 24 hours.

It should be noted that the foregoing result is not only pertinent to the liquid crystal panel of the 12-inch size but is applicable also to general liquid crystal panels having a diagonal size of 10–13 inches.

[Second Embodiment]

In the foregoing embodiment, it was assumed that the drive voltage pulse signal supplied to the data bus lines $D_1$–$D_m$ is a bipolar voltage pulse having a central voltage of 0V. The present invention, however, is never limited to such a particular driving signal but is applicable to the case in which the driving voltage pulse signal includes a D.C. voltage offset as represented in FIG. 8.

Figure 8:
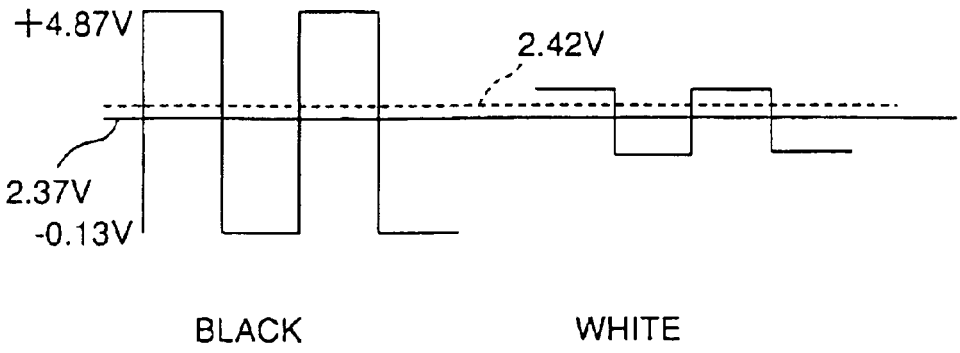
FIG. 8 is a diagram showing the waveform of another driving voltage signal according to a second embodiment of the present invention.

Referring to FIG. 8, the driving voltage pulse signal has a voltage amplitude of ±2.5V in the black representation mode, and the driving voltage pulse signal is supplied to the data bus line $D_1$–$D_m$ together with a D.C. offset of 2.37V. Thereby, an optimum common voltage $V_{Cs}$ of 2.37V, which is substantially equal to the foregoing D.C. voltage offset, is applied to the auxiliary electrode Cs and to the opposing electrode 15.

Figure 9:
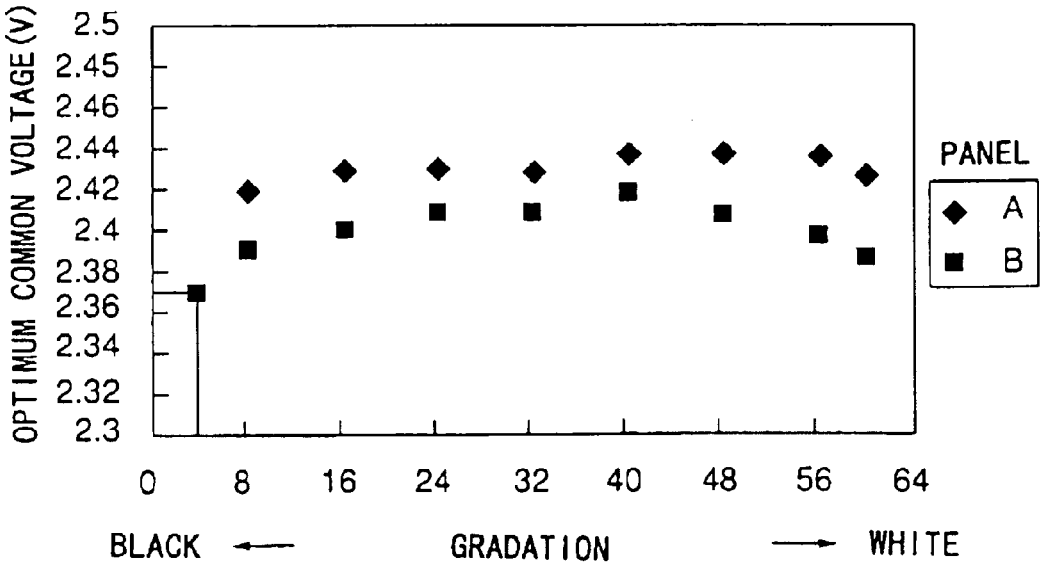
FIG. 9 is a diagram showing the optimum common voltage corresponding to the driving voltage signal of FIG. 8 according to the second embodiment.

In the driving process noted above, it should be noted that the optimum common voltage $V_{Cs}$ may be different in the black representation mode and in the white representation mode. In the example of FIG. 8, the common voltage $V_{Cs}$ optimized for the case in which the amplitude of the driving voltage pulse signal is set smaller than the threshold voltage of image representation, does not coincide with the common voltage $V_{Cs}$ of 2.37 V optimized for the black representation mode. In fact, the optimized common voltage for the foregoing case takes a value of 2.42V rather than 2.37V. FIG. 9 represents the relationship between the optimum common voltage $V_{Cs}$ and the gradation level for two different liquid crystal panels A and B.

In view of the fact that the common voltage $V_{Cs}$ is applied to the entirety of the liquid crystal panel, it is difficult to change the optimum common voltage $V_{Cs}$ adaptively depending on the gradation level to be represented. In the present invention, therefore, the optimum common voltage $V_{Cs}$ is optimized for the black representation mode in which the flow of the liquid crystal molecules in the liquid crystal layer 10C appears most significantly.

Figure 1:
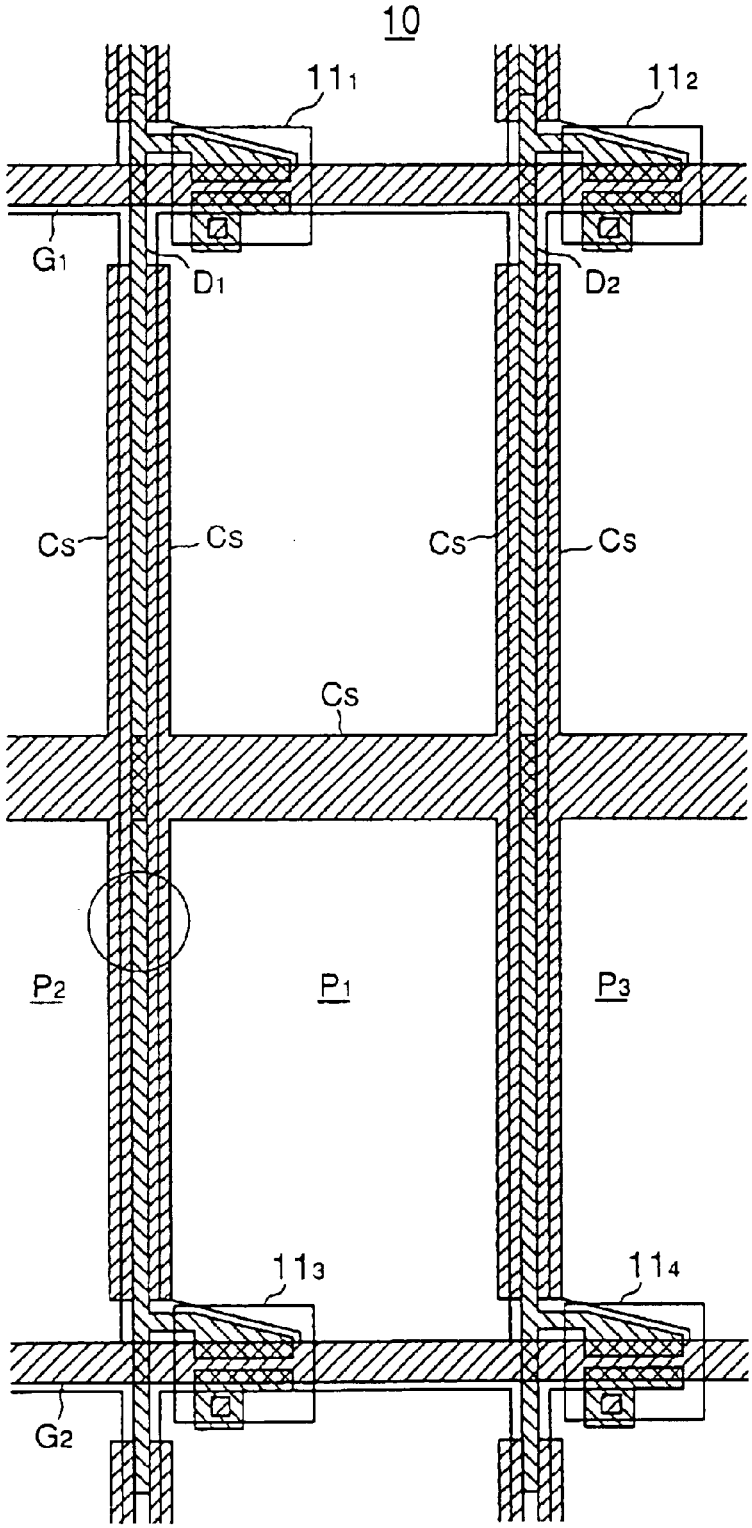
FIG. 1 is a diagram showing the construction of a liquid crystal display panel of a related art in a plan view.
Figure 2:
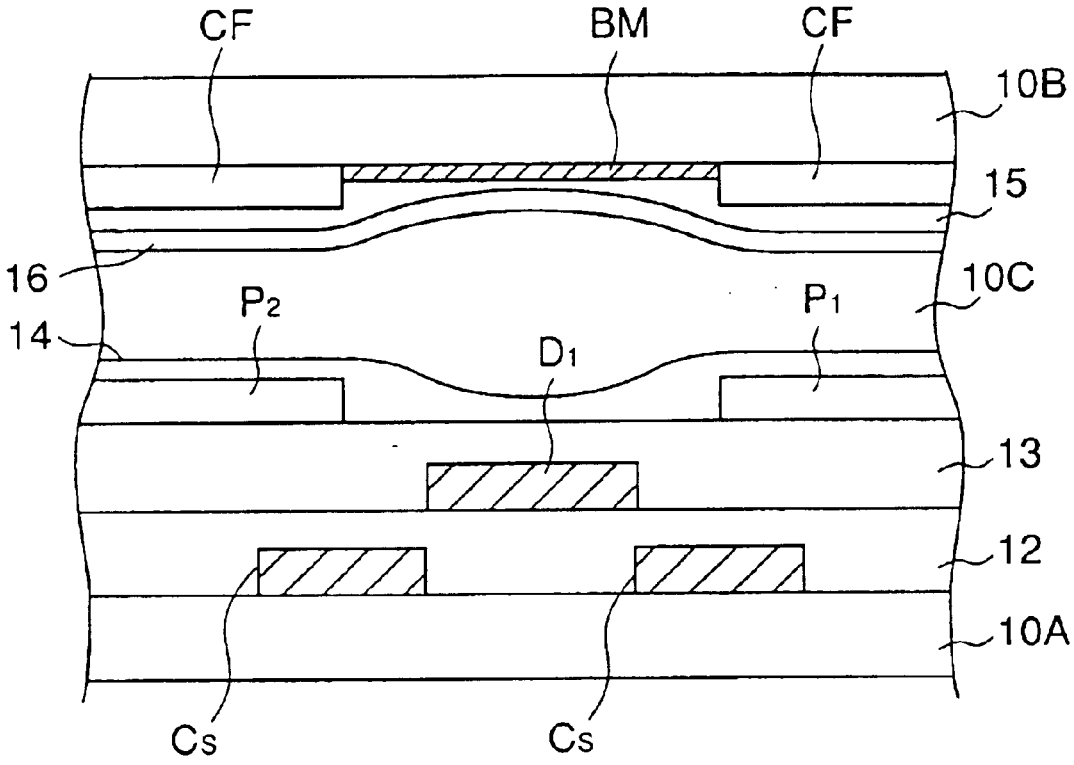
FIG. 2 is a diagram showing the construction of the liquid crystal display device of FIG. 1 in a cross-sectional view.

In the description heretofore, the present invention is described with reference to the so-called H-type Cs liquid crystal panel represented in FIGS. 1 and 2. However, the present invention is by no means limited to such a specific construction of the liquid crystal panel but is applicable to other liquid crystal panels such as "independent Cs type" or "Cs-on-gate type."

Further, the present invention is not limited to the embodiments described heretofore, but various variations and modifications may be made without departing from the scope of the invention.

What is claimed is:

1. A method of driving a liquid crystal display device, said liquid crystal display device comprising:

a first substrate;

a second substrate opposing said first substrate with a gap therebetween;

a liquid crystal layer confined in said gap;

a thin-film transistor formed on said first substrate;

a data bus line formed on said first substrate in electrical connection with said thin-film transistor, said data bus line supplying an alternate-current driving voltage signal to said thin-film transistor;

a pixel electrode provided on said first substrate in electrical connection to said thin-film transistor;

an auxiliary electrode having an H-shaped form including a pair of parallel conductor portions and a conductor portion connecting said parallel conductor portions, formed on said first substrate in the vicinity of said data bus line such that said parallel conductor portions extend along said data bus line and so as to form an auxiliary capacitance connected parallel to said pixel electrode, said auxiliary electrode being disposed so as to induce a lateral electric field between said auxiliary electrode and said data bus line;

and an opposing electrode formed on said second substrate, said method comprising the step of:

applying to said auxiliary electrode a common voltage substantially equal to a central voltage of said alternate-current driving voltage signal, wherein the liquid crystal display device is a twisted-nematic type.

2. A method as claimed in claim 1, wherein said common voltage is deviated from said central voltage by an amount corresponding to ⅖ or less of an amplitude of said alternate-current driving voltage signal set so as to provide a maximum gradation level.

3. A method as claimed in claim 1, wherein said common voltage is deviated from said central voltage by an amount corresponding to 1/20 or less of an amplitude of said alternate-current driving voltage signal set so as to provide a maximum gradation level.

4. A method as claimed in claim 1, wherein said central voltage is substantially zero volt.

5. A method as claimed in claim 1, wherein said central voltage is offset from zero volt.

6. A method as claimed in claim 1, wherein said common voltage is set such that a fluctuation of a leakage light, caused by a disclination induced in said liquid crystal layer by a lateral electric field, is 10% or less.

7. A method as claimed in claim 1, wherein said central voltage is offset from zero volt.

8. A liquid crystal display device, said liquid crystal display device comprising:

a first substrate;

a second substrate opposing said first substrate with a gap therebetween;

a liquid crystal layer confined insaid gap;

a thin-film transistor formed on said first substrate;

a data bus line formed on said first substrate in electrical connection with said thin-film transistor;

a driving circuit supplying an alternate-current driving voltage signal to said thin-film transistor via said data bus line;

a pixel electrode provided on said first substrate in electrical connection to said thin-film transistor;

an auxiliary electrode of H-shaped form including a pair of parallel conductor portions and a conductor portion connection said parallel conductor portions, formed on said first substrate in the vicinity of said data bus line so as to extend along said data bus line and so as to form an auxiliary capacitance connected parallel to said pixel electrode, said auxiliary electrode being disposed so as to induce a lateral electric field between said auxiliary electrode and said data bus line;

an opposing electrode formed on said second substrate; and a direct-current source applying, to said auxiliary electrode, a common voltage substantially equal to a central voltage of said alternate-current driving voltage signal, wherein the liquid crystal display device is a twisted-nematic type.

9. A liquid crystal display device as claimed in claim 8, wherein said direct-current source produces said common voltage such that said common voltage is deviated from said central voltage by an amount corresponding to ⅖ or less of an amplitude of said alternate-current driving voltage signal set so as to provide a maximum gradation level.

10. A liquid crystal display device as claimed in claim 8, wherein said direct-current source produces said common voltage such that said common voltage is deviated from said central voltage by an amount corresponding to 1/20 or less of an amplitude of said alternate-current driving voltage signal set so as to provide a maximum gradation level.

11. A liquid crystal display device as claimed in claim 8, wherein said driving circuit produces said alternate-current driving voltage signal such that said central voltage is substantially zero volt.

12. A liquid crystal display device as claimed in claim 8, wherein said driving circuit produces said alternate-current driving voltage signal such that said central voltage is offset from zero volt.

13. A liquid crystal display device as claimed in claim 8, wherein said direct-current source produce said common voltage such that a fluctuation of a leakage light, caused by a disclination induced in said liquid crystal layer by a lateral electric filed, is 10% or less.

14. A liquid crystal display device as claimed in claim 8, wherein said direct-current source produces said common voltage such that a flow of liquid crystal molecules, caused in said liquid crystal layer by a disclination induced in said liquid crystal layer by a lateral electric field, has a velocity of 80 $\mu$m or less per an interval of 24 hours.

15. A liquid crystal display device as claimed in claim 8, wherein said liquid crystal layer is formed of a low-voltage liquid crystal.

16. A liquid crystal display device as claimed in claim 8, wherein said auxiliary electrode extends along an edge of said conductor pattern, said liquid crystal display device thereby forming an H-type Cs liquid crystal display device.

17. A liquid crystal display device as claimed in claim 8, wherein a first driving voltage applied to the liquid crystal display device in a black representation mode is significantly larger than a second driving voltage applied to the liquid crystal display device in a white representation mode.

* * * * *

UNITED STATES PATENT AND TRADEMARK OFFICE

CERTIFICATE OF CORRECTION

PATENT NO. : 6,989,808 B2
DATED : January 25, 2006
INVENTOR(S) : Hanaoka et al.

It is certified that error appears in the above-identified patent and that said Letters Patent is hereby corrected as shown below:

Title page,
Item [56], References Cited, U.S. PATENT DOCUMENTS, add:
-- 6,353,435 3/2002 Kudo et al. --.

Column 8,
Line 43, delete "confined insaid" and insert -- confined in said --.

Signed and Sealed this

Sixteenth Day of May, 2006

JON W. DUDAS
*Director of the United States Patent and Trademark Office*

UNITED STATES PATENT AND TRADEMARK OFFICE

CERTIFICATE OF CORRECTION

PATENT NO. : 6,989,808 B2
DATED : January 24, 2006
INVENTOR(S) : Hanaoka et al.

It is certified that error appears in the above-identified patent and that said Letters Patent is hereby corrected as shown below:

Title page,
Item [56], References Cited, U.S. PATENT DOCUMENTS, add:
-- 6,353,435 3/2002 Kudo et al. --.

Column 8,
Line 43, delete "confined insaid" and insert -- confined in said --.

This certificate supersedes Certificate of Correction issued May 16, 2006.

Signed and Sealed this

Sixth Day of June, 2006

JON W. DUDAS
*Director of the United States Patent and Trademark Office*